US005201486A

United States Patent [19]

Holbrook

[11] Patent Number: 5,201,486

[45] Date of Patent: Apr. 13, 1993

[54] PORTABLE SKI PROP

[76] Inventor: Jimmy E. Holbrook, 2513 W. Marsha Brook Cir., Bennion, Utah 84118

[21] Appl. No.: 870,361

[22] Filed: Apr. 17, 1992

[51] Int. Cl.[5] ..... A47G 1/17

[52] U.S. Cl. ..... 248/206.5; 248/205.5; 248/293; 248/309.1; 248/903

[58] Field of Search ..... 248/206.5, 205.5, 291, 248/293, 309.1, 903; 294/147; 211/70.5

[56] References Cited

U.S. PATENT DOCUMENTS

| | | | |
|---|---|---|---|
| D. 313,915 | 1/1922 | Adams et al. | D6/552 |
| 2,297,806 | 10/1942 | Smith | 335/285 |
| 2,302,300 | 11/1942 | Davies | 248/206.5 X |
| 2,844,291 | 7/1958 | McPheeters | 335/285 |
| 2,956,812 | 10/1960 | Lundquist | 211/70.5 X |
| 2,977,082 | 3/1961 | Harris | 248/206.5 |
| 3,023,991 | 3/1962 | Fisher | 248/206.5 X |
| 3,258,232 | 6/1966 | Nestegard . | |
| 3,298,646 | 1/1967 | Van Buren, Jr. | 248/903 X |
| 3,329,277 | 7/1967 | Gaudino | 248/206.5 X |
| 3,497,846 | 2/1970 | Keller | 335/285 X |
| 3,746,177 | 7/1973 | Vilotti . | |
| 4,005,942 | 2/1977 | Gilb | 248/903 X |
| 4,077,554 | 3/1978 | Goode | 211/70.5 X |
| 4,078,780 | 3/1978 | Schwarz | 269/906 X |
| 4,291,823 | 9/1981 | Freeman et al. | 224/310 |
| 4,391,376 | 7/1983 | Finnegan . | |
| 4,727,462 | 2/1988 | Komonko | 248/206.5 X |
| 4,793,496 | 12/1988 | Wait | 211/70.5 |
| 4,798,298 | 1/1989 | Ursetta | 211/70.5 |
| 4,871,102 | 10/1989 | Wickersham | 224/191 |
| 4,960,258 | 10/1990 | Stocker | 248/206.5 X |
| 4,985,817 | 1/1991 | Yale | 248/206.5 X |
| 5,078,279 | 1/1992 | Hancock et al. | 211/70.5 X |

FOREIGN PATENT DOCUMENTS

| | | | |
|---|---|---|---|
| 0620818 | 12/1980 | Switzerland | 211/70.5 |

*Primary Examiner*—Ramon O. Ramirez
*Attorney, Agent, or Firm*—Lynn G. Foster

[57] ABSTRACT

A lightweight portable prop for skis and ski accessories. The ski prop is light in weight and small in size and facilely transported in a skiing environment on the person of the skier. In one embodiment, the ski prop comprises a magnetic backing, permitting the skis to be safely propped against metal bearing supports. In another embodiment, the ski prop is foldable to provide a more compact and easily carried package. Hooks are provided on the side of the ski prop for support of ski poles and other strapped, proppable accessories. In yet another embodiment, the ski prop comprises connections for other modes of releasable wall attachment permitting use of the ski prop on non-metal surfaces.

9 Claims, 3 Drawing Sheets

PORTABLE SKI PROP

FIELD OF THE INVENTION

This invention relates to props for skis and more specifically to portable ski props which are carried from place to place by skiers and which are supported by facile, releasable attachment to supporting surfaces.

BACKGROUND AND DESCRIPTION OF RELATED ART

It is well known that, whenever possible, skis should be maintained in an upright attitude at times when the skis are not being held, used or transported. Horizontally disposed or nearly horizontally disposed skis are often subject to damage as a result of being stepped on or run over and present a serious pedestrian hazard when so disposed. However, vertically disposed skis are notoriously unstable and easily imbalanced when brushed against by a person or hit by a gust of wind. Simply leaning a ski against a vertical wall or a side of an automobile may result in damage to the ski if it should become imbalanced and fall. As another consequence of a falling ski, the sharpness of ski edges may cause damage to the wall or side of the automobile as the ski falls to the ground.

In the past, U.S. Pat. No. 3,746,177 (Vilotti) disclosed a portable magnetic rack for suporting guns, fishing rods and the like propped against a metallic surface. Therein, Vilotti discloses a rack having an elongated body of resilient material which conforms to a metal car body. The elongated body of Vilotti is either impregnated with magnetic particles throughout or comprises a magnetic backing strip which flexibly conforms to a metal surface to firmly secure the rack to a car or other magnetically reactive surface. The body is made of rubber and is thick and bulky being the same thickness as the magnetic backing strip is wide.

The elongated body of Vilotti has a plurality of vertical slots to provide leaning support for guns, fishing rods and the like. As seen in FIG. 1, the slots of Vilotti are generally sized to conform to the diameter of an inserted article. Each of the plurality of slots in the elongated body is clearly seen to support only a single item. The slots are relatively shallow in inward depth, extending inward from an outward facing surface only approximately two-thirds the depth of the elongated body.

Different than guns and fishing rods, skis are normally handled in pairs and require stabilizing support well outward from the supporting surface. Extending the length of the slots of Vilotti by increasing the depth of the elongated body for use as a ski holder would undesirably increase the bulk of the elongated body and produce a heavy and undesirably burdening item to be carried on a person participating in a skiing related activity.

A useful ski prop should be constantly available to a skier as props for skis are needed nearly every time the skis are taken off. For this reason, the prop should be compact, weigh little enough to be comfortably portable on a person in skiing attire to be available whenever needed.

In addition, as ski support surfaces below a selected support site are unpredictable due to terrain and ground cover conditions, it is highly desirable to be able rotate orientation of the skis to take advantage of a differing bite of bottoms of skis relative to ground support conditions. When skis are removed for rest, dining and other off-ski purposes, it is often desirable to have a prop which is attachable to a plurality of surfaces as a metal prop supporting surface is not always available.

BRIEF SUMMARY AND OBJECTS OF THE INVENTION

In brief summary, this novel invention alleviates all of the known problems related to a light weight, portable ski prop. The ski prop comprises a relatively deep "U" shaped, outwardly extending frame. The frame comprises a pair of relatively thin outwardly extending rigid side members providing lateral support for at least one pair of skis nested together and disposed therebetween. The frame is connected to a relatively thin backplate which comprises at least one support attachment component.

In combination, the frame and the backplate are relatively small and light in weight and provide a unitary device which is compatible with being carried and used by a person in skiing attire. One embodiment of the backplate, comprises a back surface which is flat. In another embodiment of the backplate, the back surface thereof comprises a curvature which conform with attachable surfaces having a similar curvature.

In a foldable embodiment of the ski prop, the frame is hingeably connected to the backplate such that the ski pro is folded into a nearly flat package for easy insertion into a pocket or the like for transport. To extend use of the invention beyond only propping against metal objects, another embodiment of the backplate comprises a connector for releasable connection to a additional attachment components whereby the backplate is releasably attachable to a plurality surfaces. The attachment components comprising at least magnetic and vacuum attachment.

Accordingly, it is a primary object to provide a light weight, portable ski prop which is comfortably carried and usable by a skier to prop skis in a vertical attitude while in a skiing environment.

It is another primary object to provide a rigid, outwardly extending frame of the ski prop which supports a pair of skis against lateral displacement.

It is another primary object to provide a backplate which is integrally affixed to the outwardly extending frame and which has permanently affixed thereto at least one basic modality providing for releasable attachment to a support surface.

It is an object to provide a magnetically attaching modality affixed to the backplate.

It is another object to provide connections disposed on the outside lateral surfaces of the frame whereby auxiliary ski articles such as ski poles and the like are also supported by the ski prop.

It is another object to provide a ski prop, less the surface attaching components, made as a single injection molded part.

It is an important object to provide a ski prop which comprises a frame so connected to a backplate that, when in use, the frame extends outward from a supporting surface to provide lateral support for a pair of skis and that, when between uses, is folded against the backplate to provide a facilely carried package.

It is another important object to provide a molded hingeable connection between the frame and the backplate for the foldable ski prop.

It is another object to provide a foldable ski prop, less the surface attaching components, made by no more than two injection molded parts.

It is significant object to provide a light weight, portable ski prop which is carried by a skier and usable on a plurality of support surfaces.

It is another significant object to provide a backplate for the ski prop which connects to the outwardly extending frame and which comprises a plurality of attachment components for attachment to a plurality of support surfaces.

It is another significant object to provide a backplate for the ski prop which comprises at least one releasable attachment member whereby releasable attachment is made to at least one surface attaching component.

These and other objects and features of the present invention will be apparent from the detailed description taken with reference to accompanying drawings.

DETAILED DESCRIPTION OF THE ILLUSTRATED EMBODIMENTS

In this description, the term proximal is used to indicate the segment of the device normally closest to the object of the sentence. The term distal refers to the other end. The term nesting is used to describe a space efficient assemblage or package of parts. As an example, skis without bindings are considered to be nested when upright and disposed in ski top to ski bottom relationship. However, skis with bindings are considered to be nested when disposed ski bottom against ski bottom.

Figure 1:
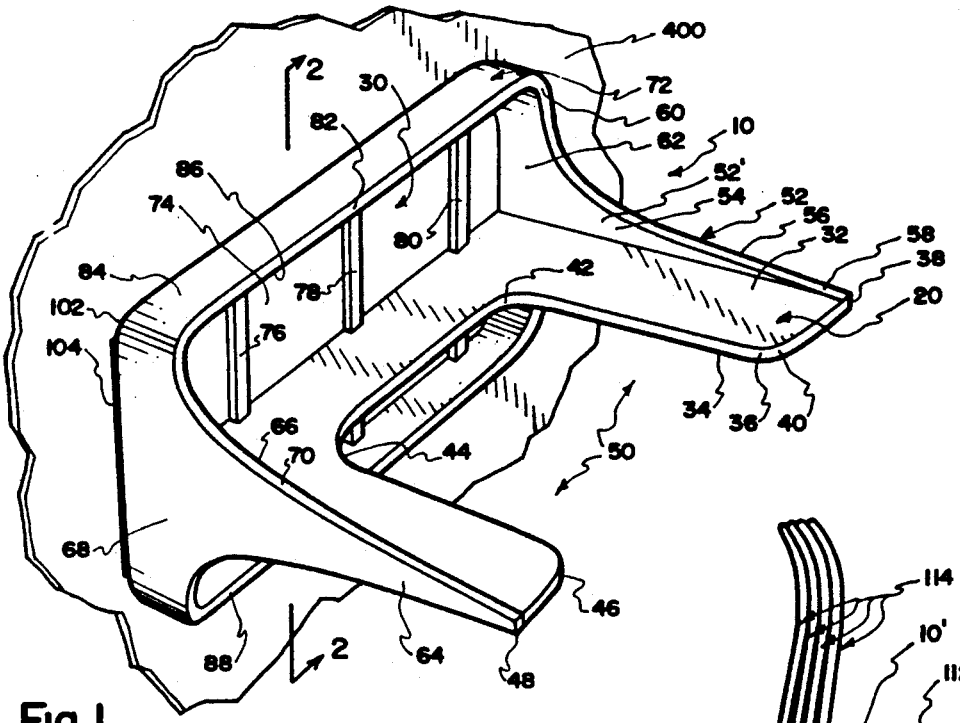
FIG. 1 is a perspective of a rigid ski prop releasibly attached to a surface.

Reference is now made to the embodiments illustrated in FIGS. 1-11 wherein like numerals are used to designate like parts throughout. As seen in FIG. 1, in one embodiment, a ski prop 10 comprises a "U" shaped frame 20 projecting normally outward from a backplate 30 as a single unitary structure. All parts of frame 20 and backplate 30 are made as thin as possible to assure a lightweight structure which is consistent with portage requirements of a skier while retaining sufficient strength to laterally restrain at least one pair of skis from falling while propped therein.

Frame 20 comprises a planar top surface 32, a planar bottom surface 34, parallel thereto, and a medially disposed edge 36. Medially disposed edge 36 and therefore the thickness of frame 20 comprises sufficient mass to resistively support lateral forces of skis propped within ski prop 10 without significant deflection of edge 36. Medially disposed edge 36 follows a path which extends from a rightmost corner 38, as seen in FIG. 1, laterally to a rounded corner 40. From rounded corner 40, medially disposed edge 36 extends toward backplate 30 to corner 42 and therefrom parallel to backplate 30 to another corner 44. From corner 44, medially disposed edge extends away from backplate 30 to a rounded corner 46 and therefrom laterally to corner 48. The path of medially disposed edge describes an opening or mouth 50 which accepts at least one pair of nested skis and provides lateral support along the medially disposed edge 36 between corners 40 and 42 and between corners 44 and 46. Further, propping support is provided by the medially disposed edge 36 between corners 42 and 44.

Referring again to corner 38, frame 20 is joined thereat to a side support member 52 which is disposed at right angles to frame 20 and extends from corner 38 toward backplate 30. A top o portion 52' of side support member 52 comprises an inside surface 54, an outside surface 56 (which is unseen in FIG. 1), and an edge 58. Edge 58 follows a path which diverges from the top surface 32 of frame 20 at corner 38 to a corner 60 to define a supporting gusset 62 for frame 20. Below frame 20, beginning at corner 38, another portion of support member 52, unseen in FIG. 1, is identically patterned after the top portion just described and is therefore not further described. Disposed laterally across frame 20 on a side opposite side support 52 is another side support member 64 which is a mirror image of side support member 52 and comprises an inside surface 66, an outside surface 68, and an edge 70. In opposite hand format, the form and function of side support member 64 is the same as side support member 52 and therefore no further of side support member 64 description is necessary.

Backplate 30 comprises a connecting rim 72, a rear panel 74, and a plurality of support ribs 76, 78, 80. As a part of a top portion of backplate 30, rim 72 comprises an edge 82 disposed forward of rear panel 74 and contiguous with edge 58 at corner 60. Edge 82 is similarly contiguous with edge 70. Connecting rim 72 further comprises an external surface 84 and an internal surface 86, external surface 84 being disposed between edge 82 and rear panel 74 and integrally connected with outside surfaces 56 and 68. Internal surface 86 is similarly disposed between edge 82 and rear panel 74 and integrally connected to inside surfaces 54 and 66. A bottom portion of rim 72 comprises an edge 88 which follows a structure defining path for a lower portion of backplate 30 which is a mirror image of that described for edge 82 of rim 72. As the lower portion of backplate 30 is a mirror image of the top portion about a central plane through frame 20, no additional description of the lower portion of backplate 30 needs to be provided.

Figure 2:
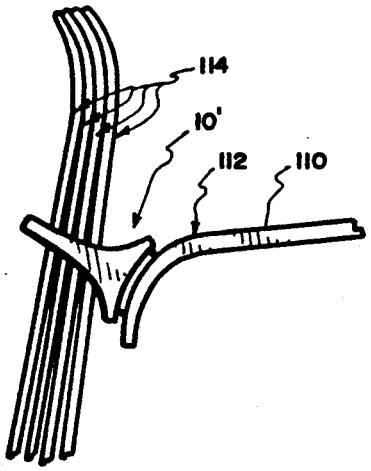
FIG. 2 is a cross section taken along lines 2—2 of FIG. 1 showing a substantially flat backplate.
Figure 2:
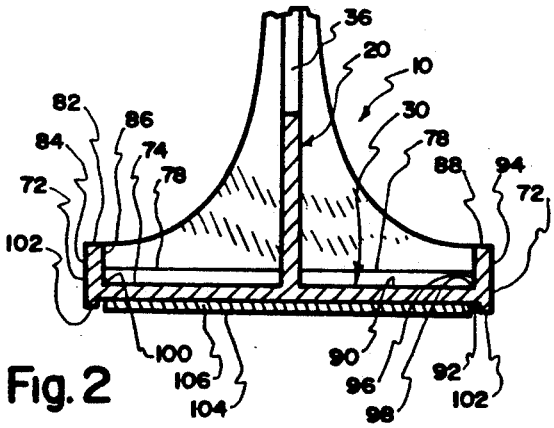

Referring again to FIG. 1, ribs 76, 78, and 78 of backplate 30 are used to provide structural strength for rear panel 74, thereby permitting rear panel 74 to be made as thin as possible in lieu of otherwise used, weight adding material. A cross section of backplate 30 is seen in FIG. 2. As seen therein, rear panel 74 comprises a frontally disposed surface 90 and a rear surface 92. Contiguous with edge 88, rim 72 comprises an external surface 94 and an internal surface 96. Rear panel 74 is seen to be flat or planar with frontally disposed surface 90 integrally joined with internal surface 96 and internal surface 86 at corners 98 and 100, respectively. However, external surface 84 of rim 72 extends rearward of rear surface 92 as does external surface 94 to form a raised edge 102 which protects a sheet 104 of magnetic material disposed therein. Sheet 104 comprises a cross sectional edge 106 which illustrates the thickness of sheet 104. Sheets of magnetic material for use as sheet 104 are available in the art. Sheet 104 is bonded or glued to the rear surface 92 of backplate 30 by methods which are well known in the art. The extension of raised edge 102 rearward from rear surface 92 is less than the distance across cross sectional edge 106 to permit sheet 104 to contact a surface without interference from raised edge 102.

Figure 4:
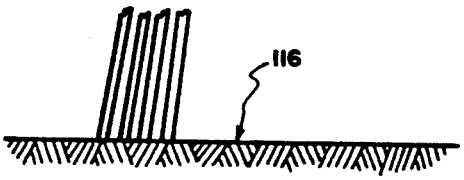
FIG. 4 is a side elevation of a ski prop retained on a supporting surface and thereby supporting a plurality of nested pairs of skis.
Figure 3:
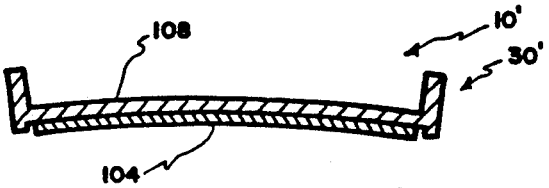
FIG. 3 is a cross section of a portion of a ski prop showing a backplate having a predetermined radius of curvature.

As seen in another embodiment in FIG. 3, a backplate 30' of a ski prop 10' comprises a rear panel 108 and a sheet 104 of magnetic material. Note that rear panel 108 is curved to provide a curvature which is non-planar. As seen in FIG. 4, ski prop 10' is releasably attached to a rounded surface 110 which is a curved surface of a portion of a car body 112. Ski prop 10' seen therein is containing in a propped condition a plurality of skis 114. Note that the majority of the weight of skis 114 rests on a ground or horizontal support 116. Such is the common mode of support for skis 114 in each ski prop of this invention.

Exclusive of magnetic sheet 104, ski props 10 and 10' may be made from synthetic resinous material which cures to a rigid state and comprises sufficient strength to provide lateral support for at least one pair of skis 114 propped for vertical support therein. Such materials are known and available in the art. As such, ski props 10 and 10' may be made by injection molding or like mass production methods. In one preferred embodiment ski prop 10 comprises a frame which is less than 4.5 inches wide, and extends outwardly from a backplate between 2.5 and 3.5 inches. The backplate of this embodiment is also 4.5 less than inches wide and is between 1.5 and 2.5 inches in height and weighs less than three ounces, thereby providing a compact, easily stored and carried prop for skis.

Figure 6:
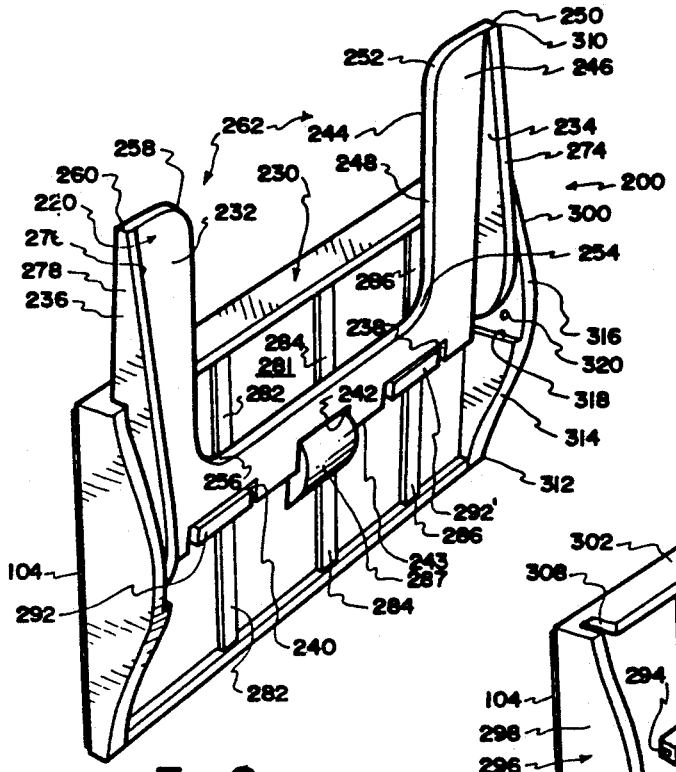
FIG. 6 is a perspective of a foldable ski prop disposed in a folded state.
Figure 5:
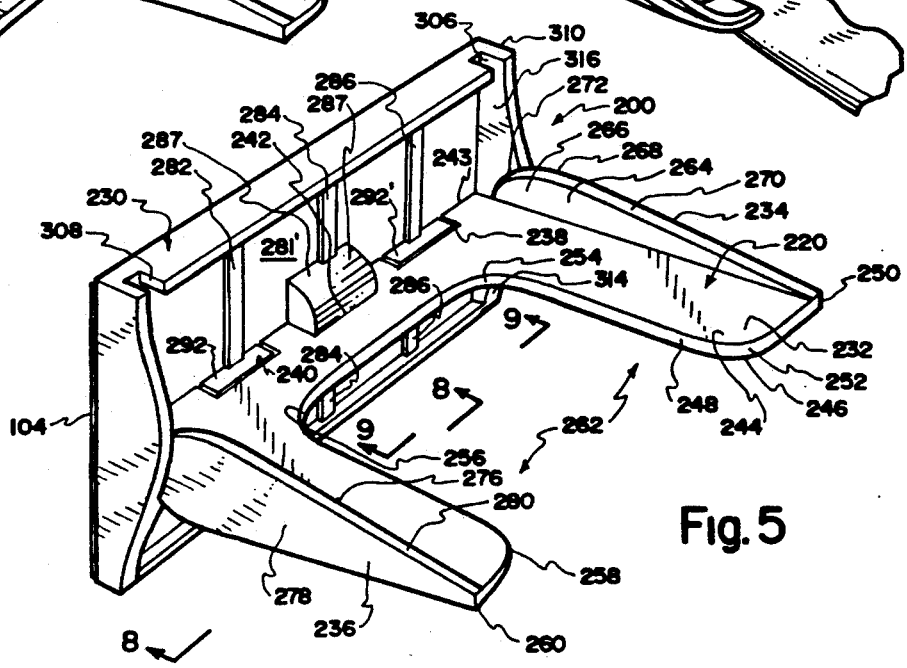
FIG. 5 is a perspective of a foldable ski prop comprising an outwardly extending frame.

Another embodiment of a ski prop is seen in FIG. 5, wherein a foldable ski prop 200 is seen in an unfolded state. Ski prop 200 is seen in a folded state in FIG. 6. Ski prop 200 is similar in form, function, size and weight to ski prop 10 comprising a frame 220 and a backplate 230. However, the frame 220 is foldable relative to backplate 230. As seen in FIGS. 5 and 6, frame 220 comprises a center section 232, a pair of side strengthening members 234 and 236, and a pair of laterally disposed recesses 238 and 240 and a centrally disposed recess 242 along a side 243 juxtaposed backplate 230.

Center section 232 comprises a planar top surface 244, a planar bottom surface 246, parallel thereto, and a medially disposed edge 248. Medially disposed edge 248 defines the thickness of frame 220 which comprises sufficient mass to resistively support lateral forces of skis propped within ski prop 200 without substantial deflection of edge 248. Medially disposed edge 248 follows a path which extends from a rightmost corner 250, as seen in FIGS. 5 and 6, laterally to a rounded corner 252. From rounded corner 252, medially disposed edge 248 extends toward a site where frame 220 hingeably connects to backplate 230 to corner 254 and therefrom laterally and parallel to backplate 230 to another corner 256. From corner 256, medially disposed edge extends away from another site where frame 220 hingeably connects to backplate 230 to a rounded corner 258 and therefrom laterally to corner 260. The path of medially disposed edge describes an opening or mouth 262 which accepts at least one pair of skis and provides lateral support along the medially disposed edge 248 between corners 252 and 254 and between corners 256 and 258. Further, propping support is provided by the medially disposed edge 248 between corners 254 and 256.

Referring again to corner 250, frame 220 is joined thereat to a side support member 234 which is disposed at right angles to center section 232 and extends from corner 250 toward the junction with backplate 230. A top portion 264 of side support member 234 comprises an inside surface 266, an outside surface 268 (which is unseen in FIGS. 5 and 6), and an edge 270 (best seen in FIG. 5). Edge 270 follows a path which diverges from the top surface 244 of frame 220 at corner 250 to a rounded corner 272. Rounded corner 272 is disposed proximal to but separated from side 243 to provide clearance for folding rotation of frame 220 relative to backplate 230. As best seen in FIG. 6, under frame 220 and beginning at corner 250, another portion of side support member 234 comprises an edge 274 which is identical, but of opposite hand, to that of edge 270 such that edges 270 and 274 converge where side support member 234 is affixed to center section 232.

Disposed laterally across frame 220 is another side support member 236 which is a mirror image of side support member 234 and comprises an inside surface 276, an outside surface 278, and an edge 280. In opposite hand format, the form and function of side support member 236 is the same as side support member 234 and therefore no further description of side support member 236 is necessary.

Figure 7:
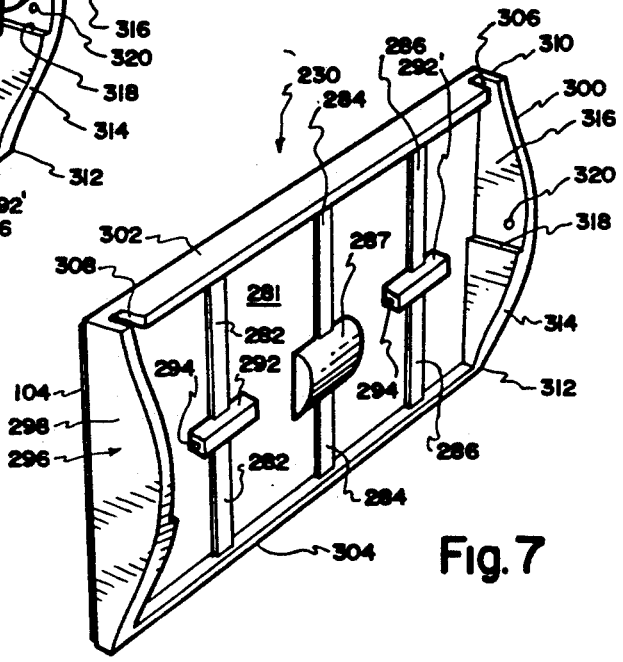
FIG. 7 is a perspective of a portion of a backplate for the foldable ski/prop.

Backplate 230 without an attached frame 220 is seen in FIG. 7. Backplate 230 comprises a rear panel 281 and ribs 282, 284 and 286 which are similar in form and function to ribs 76, 78 and 80 of backplate 30. Also, backplate 230 comprises a raised block 287 which is used for attachment of additional vertical attachment components as described in detail hereafter. Ribs 282, 284 and 286 and raised block 287 are permanently and integrally affixed to rear panel 281.

Figure 9:
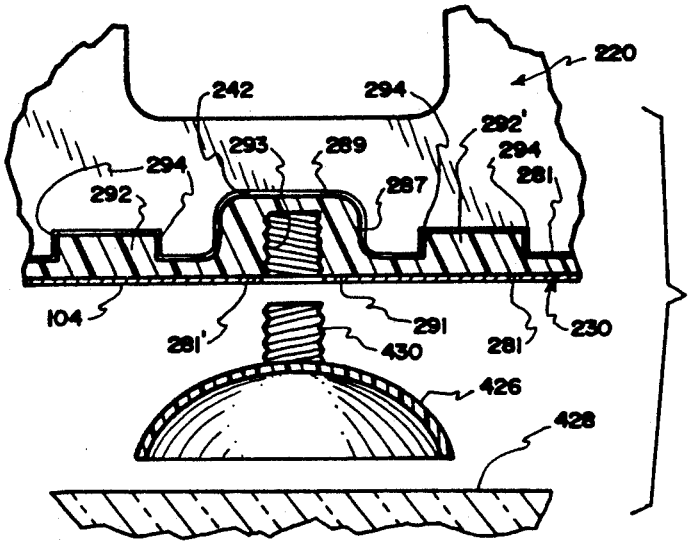
FIG. 9 is a cross section along lines 9—9 in FIG. 5 illustrating a portion of the ski prop and an attachable auxiliary connecting component.

Raised block 287 is best seen in cross section in FIG. 9. Raised block 287 comprises a forward facing surface 289 and a rearward facing surface 291. Rearward facing surface 291 is in the same plane as and contiguous with a rear surface 281' of rear panel 281. Raised block 287 comprises a threaded attachment hole 293. Also seen in FIG. 9 is a cross section of a suction cup 426 and smooth, non-porous surface 428 such as glass, tile, an enameled wall or the like. Suction cup 426 and surface 428 are not seen in FIG. 5. Suction cup 426 comprises a threaded attachment screw 430 for releasable attachment to backplate 230 via threaded hole 293. Once attached to backplate 230, suction cup 426 provides an alternate connector to a non-magnetic, vacuum retainable wall surface such as surface 428.

Referring again to FIG. 7, medially disposed on rear panel 281 at right angles to rib 282 is a hinge block 292 which is sized and disposed to fit into recess 240 to provide a stationary hinge component when frame 220 is disposed thereat. On each end, hinge block 292 comprises a nipple or protrusion 294, the purpose and function of which is described in detail hereafter. A similar hinge block 292' is similarly disposed at right angles to rib 286 to provide a second stationary hinge component.

Backplate 230 comprises a raised border 296 comprising two side members 298 and 300, a top member 302 and a bottom member 304. Each member 298, 300, 302, and 304 provides strengthening support for backplate 230 in place of a more bulky rear panel which would otherwise be needed.

Top member 302 comprises a pair of slots 306 and 308 disposed in line with side support members 234 and 236, respectively such that when frame 220 is folded against backplate 230 a more compact package results. Side member 300 is integrally joined to top member 302 at corner 310 and to bottom member 304 at corner 312. A lower portion 314 of side member 300 is thicker than a higher portion of 316 above a shelf 318 in side member 300 by the width of shelf 318. Side member 300 bows outward from rear panel 281 to a substantially greater width at shelf 318 than at corners 310 and 312. The purpose and function of shelf 318 is described in detail later. Side member 300 also comprises a cavity 320 in predetermined relation to shelf 318 for a purpose also described later. Side member 298 is identical in form and function to side member 300, but of opposite hand and is therefore not further described.

Figure 8:
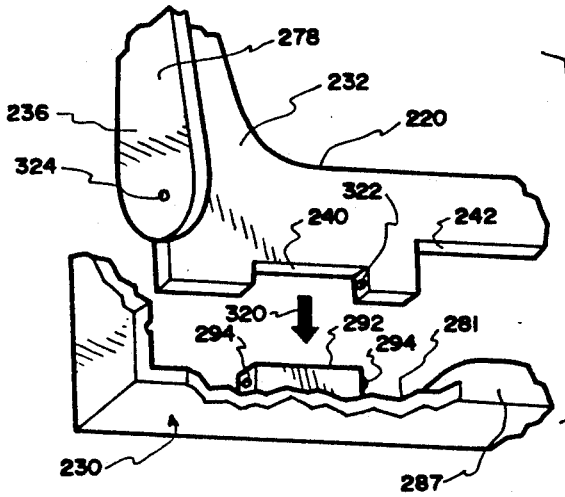
FIG. 8 is an exploded perspective along lines 8—8 of FIG. 5.

Reference is now made to FIG. 8 wherein a portion of frame 220 is seen separated from backplate 230. As seen in one end of recess 240, recess 240 comprises a circular cavity 322. Such a cavity 322 is disposed at each end of recess 240 and is sized and shaped to receive a protrusion 294. The dimensions of recess 240, cavities 322, hinge block 292 and protrusions 294 disposed on each end thereof are sized and shaped to be snapped together to provide a permanent hinge during assembly. In similar fashion, recess 238 and hinge block 292' comprise similar snap together components to make another hinge at the site thereof. The size of recess 242 is great enough to permit clearance of raised block 287 through all folding angles of frame 220 relative to backplate 230.

As is also seen in FIG. 8, side support member 236 comprises a protuberance 324. As shown protuberance 324 is disposed upon side support member 236 such that when frame 220 is opened as seen in FIG. 5, protuberance 324 snaps into a juxtaposed cavity 320 in side support member 236 to form a releasable connection. In addition, when frame 220 is so opened, each lower edge of each side member, as an example, lower edge 274 of support member 234, rests upon shelf 318 for stabilizing support.

Material and methods used in manufacture of ski prop 10 may also be used to manufacture ski prop 200. However, frame 220 and backplate 230 are made as separate parts and later joined by an assembly process. To assemble ski prop 200, frame 220 is joined to backplate 230 by forcing recesses 238 and 240 about hinge blocks 292 and 292', respectively, in the direction of arrow 320 as seen in FIG. 8.

Figure 10:
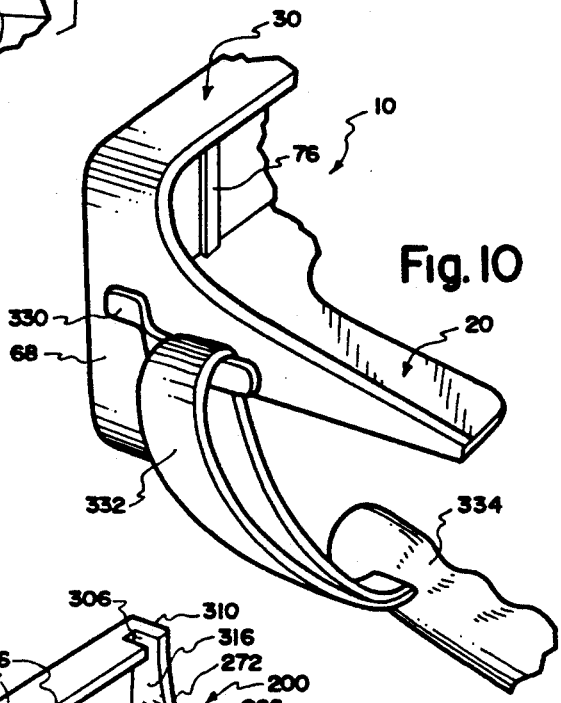
FIG. 10 is a perspective of a portion of a ski prop showing a horizontally disposed hook on the side of the frame and a strap of a ski pole being supported thereby.
Figure 11:
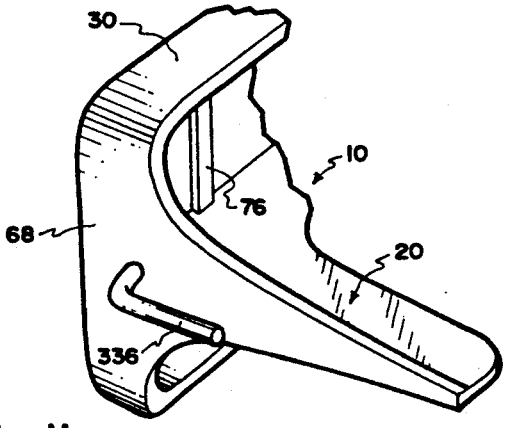
FIG. 11 is a perspective of a portion of another ski prop showing another horizontally disposed hook on the side of the frame.

As a skier employs items in addition to skis which are in need of vertical support when not in use, provisions for a side support of such items having straps are seen in FIGS. 10 and 11. As seen in FIG. 10, a strap bearing hook 330 which is an integrally molded part of ski prop 10 provides propping support for a strap 332 of a ski pole 334 (only partially shown). As seen in FIG. 11, a metal hook 336 is threadably attached through surface 68 and glued or bonded in place to ski prop 10 to perform the same function as hook 330.

In summary, this novel invention provides a small, light weight, portable ski prop which can be facilely stored in a skiers normal attire and which is releasably magnetically attached for use to a vertical surface 400 as seen in FIG. 1. The ski prop can be used to prop skis in a nesting orientation as seen in FIG. 4 or in an opposite nesting configuration with bindings outwardly disposed. In any event, it is understood that skis are joined in a nesting relationship, either top of ski to bottom of ski or bottom to bottom in pairs supported relationship with the ski prop. Also, as seen in FIG. 4, a backplate of the ski prop may be curved to match and releasably attach to a surface of predetermined curvature. In various embodiments, ski props provide propping support for skis against a variety of support surfaces. By releasable attachment, a plurality of attachment components may be added to the ski prop the increase the versatility of use thereof. Further, side appendages are added to the ski prop for propping auxiliary ski equipment.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A lightweight portable prop for at least one pair of skis comprising:

a rigid backplate comprising means for releasibly attaching at a rear side of said backplate to a ski supportable, substantially vertical surface;

means for restraining the skis in a nested, propped attitude against lateral movement relative to the vertical surface, said restraining means being thin relative to the height of said backplate and comprising means for integrally connecting to said backplate;

said connecting means comprising means for hingeably connecting said ski restraining means to said backplate whereby said lightweight portable prop is folded into a substantially planar orientation for transport and storage.

2. The lightweight portable prop according to claim 1 wherein, in combination, said backplate and ski restraining means comprise means for latching said restraining means in a ski restraining orientation relative to said backplate.

3. A method of using a portable ski prop comprising the steps of:

providing at least one pair of skis;

providing said ski prop from adjacent storage such as in a skier's attire or from a vehicle;

selecting a magnetically reactive wall site for propping the pair of skis in a generally vertical orientation;

magnetically attaching the ski prop to the wall site;

placing at least two of the skis into a generally vertical orientation such that one end of each ski is supported on a surface generally below the ski prop;

leaning each surface engaging ski into an open slot in said magnetically attached ski prop so that at least two of said skis are contiguous with each other in the slot;

disposing a strap of a ski pole about a hook on the ski prop for support thereof.

4. A method of using a portable ski prop comprising the steps of:

providing a plurality of skis;

providing said ski prop from adjacent storage;

selecting a wall site for propping at least two of the skis in a generally vertical orientation;

releasibly attaching the ski prop to the wall site using a suction cup forming part of the ski prop;

placing at least two of the skis into a generally vertical orientation such that one end of each ski is supported on a surface generally below the ski prop;

leaning each surface engaging ski into an open slot in the releasibly attached ski prop in an unclamped condition so that at least two of said skis are contiguous with each other in the slot.

5. The method according to claim 4 further comprising the step of:

disposing a strap of a ski pole about a hook on the ski prop for support thereof.

6. A portable prop for stabilizing a plurality of ground engaging generally vertical extending skis, the prop comprising:

a rigid tee-shaped body with moving parts comprising:

a base plate member comprising magnetic means effective at an exposed surface thereof whereby the prop is releasibly held to a metal mounting side for the prop; and a rigid ski gathering plate member integral with, cantilevered away from, and extending at a large acute angle to the base plate member, the ski gathering plate member comprising a gathering slot for accepting an elevated end part of at least two leaning, generally vertical contiguous, ground engaging skis in nested unclamped relation;

the rigid ski gathering plate member comprising rigid support means at each side of the gathering slot to stabilize the contiguous elevated nested ends of the vertically extending skis leaning within the gathering slot.

7. The portable prop according to claim 6 further comprising two upper and two lower gusset plate stabilizers disposed between the base plate member and the ski gathering plate member, each at a location outside of the gathering slot.

8. A method for using a portable ski prop comprising the steps of:

carrying the ski prop and a plurality of skis separately in a vehicle to a desired location;

manually placing the ski prop in releasible magnetically secure relationship at an exterior magnetically reactive wall site of the vehicle;

standing at least two skis on one end each so that these skis rest on a surface below the ski prop and extend generally vertically upward;

leaning an elevated end of each surface engaging generally vertically extending ski slightly into a single ski gathering slot of said magnetically attached ski prop;

retaining the elevated ends of the skis in stable contiguous nested unclamped relation within the singe gathering slot for a period of time;

removing the elevated end of the skis from the single gathering slot of the magnetically attached ski prop;

manually detaching the ski prop from the wall site by grasping and displacing and storing the same.

9. A method for propping at least one nested pair of skis comprising the steps of non-magnetically releasibly attaching a ski prop to a wall in a ski propping attitude;

placing at least two skis in a nested orientation;

positioning a lower end of at least two skis upon the ground below the ski prop and extending the other end into the air;

leaning the upper end of the ground engaging skis into one open mouth region of said ski prop in unclamped propped orientation and restraining the ground engaging skis in said propped orientation against falling rotation of the unclamped upper end of each propped ski.

* * * * *